US005682784A

United States Patent [19]

Stoynoff, Jr.

[11] Patent Number: 5,682,784

[45] Date of Patent: Nov. 4, 1997

[54] ROLL FORMING TOOL FOR MANUFACTURING LOUVERED SERPENTINE FINS

[75] Inventor: Richard P. Stoynoff, Jr., Woodhaven, Mich.

[73] Assignee: Livernois Research & Development Company, Dearborn, Mich.

[21] Appl. No.: 693,435

[22] Filed: Aug. 7, 1996

Related U.S. Application Data

[63] Continuation-in-part of Ser. No. 554,482, Nov. 7, 1995.

[51] Int. Cl.[6] ..... B21D 53/04

[52] U.S. Cl. ..... 72/186; 72/326

[58] Field of Search ..... 72/186, 196, 326

[56] References Cited

U.S. PATENT DOCUMENTS

| | | | |
|---|---|---|---|
| 1,640,147 | 8/1927 | Fedders et al. | 72/196 |
| 1,862,219 | 6/1932 | Harrison . | |
| 1,887,036 | 11/1932 | Modine . | |
| 2,789,797 | 4/1957 | Simpelaar . | |
| 3,003,749 | 10/1961 | Morse . | |
| 3,145,586 | 8/1964 | Brearley et al. . | |
| 4,067,219 | 1/1978 | Bianchi . | |
| 4,328,861 | 5/1982 | Cheong et al. . | |
| 4,469,168 | 9/1984 | Itoh et al. . | |
| 4,676,304 | 6/1987 | Koisuka et al. . | |
| 4,815,531 | 3/1989 | Presz, Jr. et al. . | |
| 5,372,187 | 12/1994 | Haushalter . | |
| 5,511,610 | 4/1996 | Lu . | |

FOREIGN PATENT DOCUMENTS

| | | | |
|---|---|---|---|
| 69396 | 4/1983 | Japan . | |
| 142197 | 8/1983 | Japan . | |
| 38597 | 2/1989 | Japan . | |
| 3-142020 | 6/1991 | Japan | 72/326 |

*Primary Examiner*—Lowell A. Larson
*Attorney, Agent, or Firm*—Brooks & Kushman P.C.

[57] ABSTRACT

A roll forming tool for manufacturing louvered serpentine fins. The tool has a plurality of fin blades each having a predetermined size and shape. Each of the blades has a plurality of cutting edges for forming scallops in a serpentine fin such that a louvered serpentine fin is formed. The blade forms the louvers in the fins that create a turbulent air flow and thus increase the rate of heat exchange in a heat exchanger.

16 Claims, 5 Drawing Sheets

ROLL FORMING TOOL FOR MANUFACTURING LOUVERED SERPENTINE FINS

CROSS-REFERENCE TO RELATED APPLICATION

This application is a continuation-in-part of application Ser. No. 08/554,482, filed Nov. 7, 1995, and entitled "Heat Exchanger With Turbulated Louvered Fin, Manufacturing Apparatus, And Method".

TECHNICAL FIELD

This invention relates to a roll forming tool for use in manufacturing serrated louvers. More specifically, the present invention relates to a roll forming tool for manufacturing such louvers on a serpentine heat exchanger fin that utilizes physical media to either extract heat or cold from a source.

BACKGROUND ART

It is generally known that a layer or film of fluid of indefinite thickness exists when a heat- or cold-transferring fluid contacts with a surface having a different thermal energy than the fluid. That layer is in direct contact with the heating surface, to which it tends to adhere and form a relatively thermally insulating covering. The covering reduces the rate of transfer of thermal energy to those regions of the fluid which are located away from the heating surface. Such adherence is explained by friction between the fluid and the surface which causes the layer to move more slowly in relation to the more remote layers of fluid which may pass relatively unencumbered over the adherent layer. Such phenomena tend to diminish the efficiency of a heat exchanger. As a result, prior art heating approaches have used relatively large areas of heating surface in order to heat a fluid to a desired temperature.

Broadly stated, these prior art approaches have addressed the problem by disturbing this essentially non-conductive layer and enabling most of the fluid to be heated to come into direct contact with the heating surface by modifying the surface. Such approaches have been only somewhat effective in raising the efficiency of a heat exchanger.

The surface over which the heat transfer occurs is called a fin or louver. The louver deflects or directs the air and channels heat or coldness from a source. In existing louver designs, little turbulence actually occurs and laminar flow is relatively uninterrupted. Although the use of these louvers or fins are commonly used to deflect air in conventional heat exchangers, other uses for these fins have included with air filters, air deflectors, structural spacers, noise reducers, and some electrical device components. Other details of the louvers and their characteristics are laid out in Applicant's related copending application Ser. No. 08/554,482, which is hereby incorporated by reference.

The louvers or fins are typically produced by a roll forming tool called a finroll. Existing roll forming tools, called finrolls, include a set of rolls which are each part of a separate rotating assembly. The finrolls are designed so that when they are mated and rolled in unison with each other, they will produce a louvered serpentine fin when a strip of material is introduced into the mating area of the finrolls. Existing finrolls are made up of a series of differently shaped blades or disks which are characterized by an outer peripheral shape and thickness. The thickness of each blade is a variable and is determined usually by the width of the louver that is to be manufactured. The outer perimeter of the disk is used to either preform or finish form the serpentine shape. It is also known to provide an offset on non-symmetrical blade flanks on the finroll to compensate for unequal rolling stresses induced into the fins.

The louvers or fins are commonly manufactured from cladded aluminum in order to aid an abrasion process of creating the heat exchanger finish core. It is also known that tools which perform high speed slitting of abrasive materials, such as cladded aluminum, tend to wear out more quickly, and thus have a decreased life. Thus, prior tools for forming louvered serpentine fins tended to have a relatively short use life.

SUMMARY OF THE INVENTION

It is an object of the present invention, to provide a tool having corrugated blade edges for producing a scalloped louver that will provide for more efficient heat transfer. It is also an object of the present invention to increase finroll tool life.

By use of the disclosed tool, a corrugated edge is formed upon one or more of the louvers for creating turbulence in the fluid. This turbulence disturbs laminar flow of the fluid across the associated louver and promotes a transfer of thermal energy between the medium in the tubes and the fluid.

The tool for manufacturing the louvered serpentine fins is a roll forming tool that simultaneously rolls, cuts, and forms serpentine fins with scalloped edges that have some turbulating characteristics. The tool is comprised of a pair of intermeshing stacked sets of star-shaped blades. Each blade has a plurality of serrated cutting edges that cut the workpiece, such as a piece of cladded aluminum, to form the louvered serpentine fins while also providing for extended tool life. The blades contact the workpiece where the pair of stacked sets of star-shaped blades intermesh.

BEST MODES FOR CARRYING OUT THE INVENTION

A new turbulator fin and an improved tool for manufacturing the fin are needed to address concerns of cost, performance, strength, and create a direct replacement component for the currently used louvered serpentine fin. Thus, an object of the present invention is to provide a tool for manufacturing louvered serpentine fins with a shape that creates turbulence. Details about the various configurations of the fin itself are laid out in Applicant's aforementioned related co-pending application Ser. No. 08/554,482, which is hereby incorporated by reference.

With the preferred embodiment of the manufacturing tool to be disclosed, a product is made which has small turbulating structures designed into the louver surface. These small turbulating structures, also referred to as scallops, create turbulence in the air that flows over the louver surface, thus increasing the efficiency of heat exchange.

Figure 1:
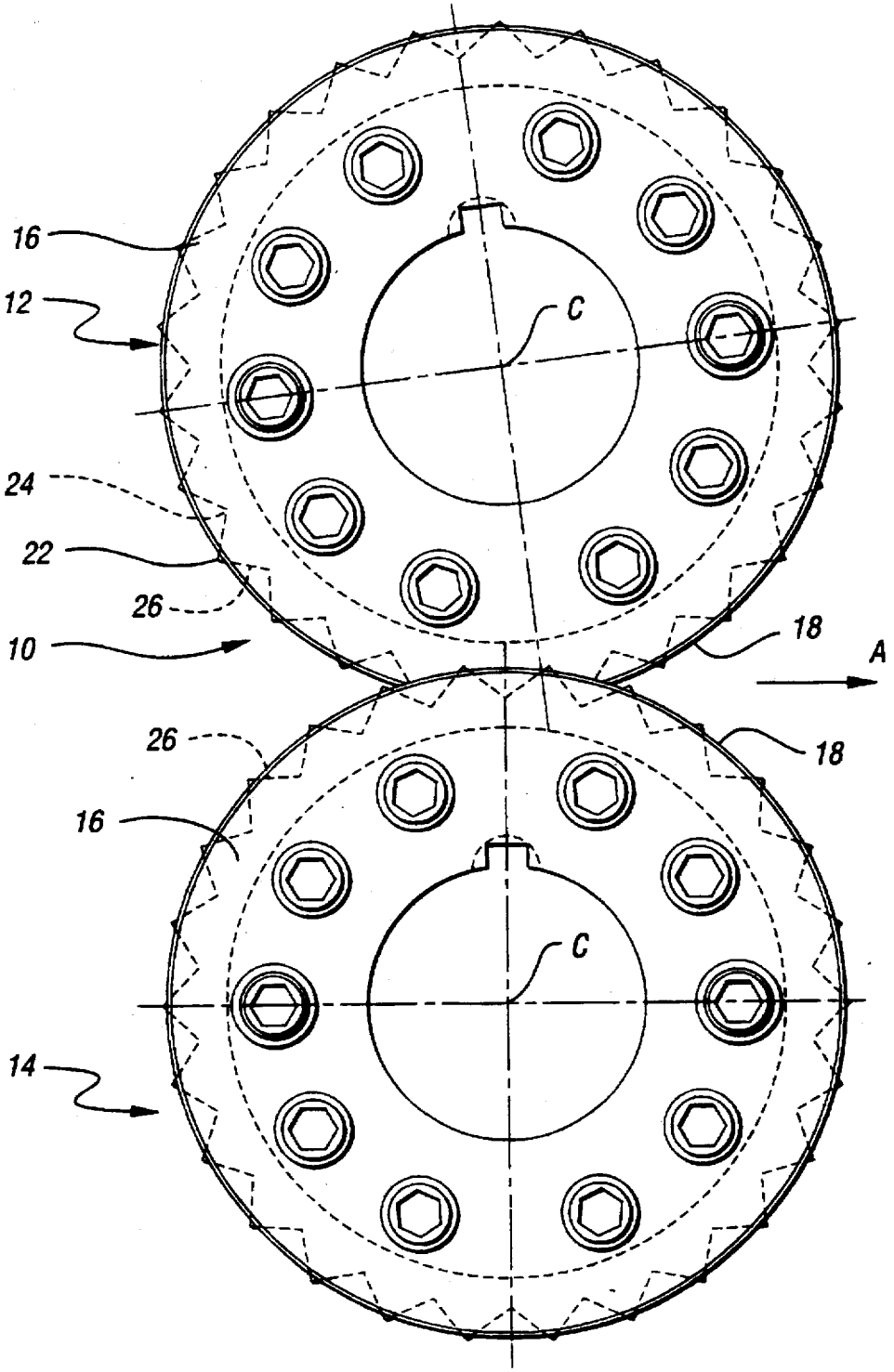
FIG. 1 illustrates a pair of roll forming tools for manufacturing the louvered serpentine fins in accordance with the present invention.
Figure 2:
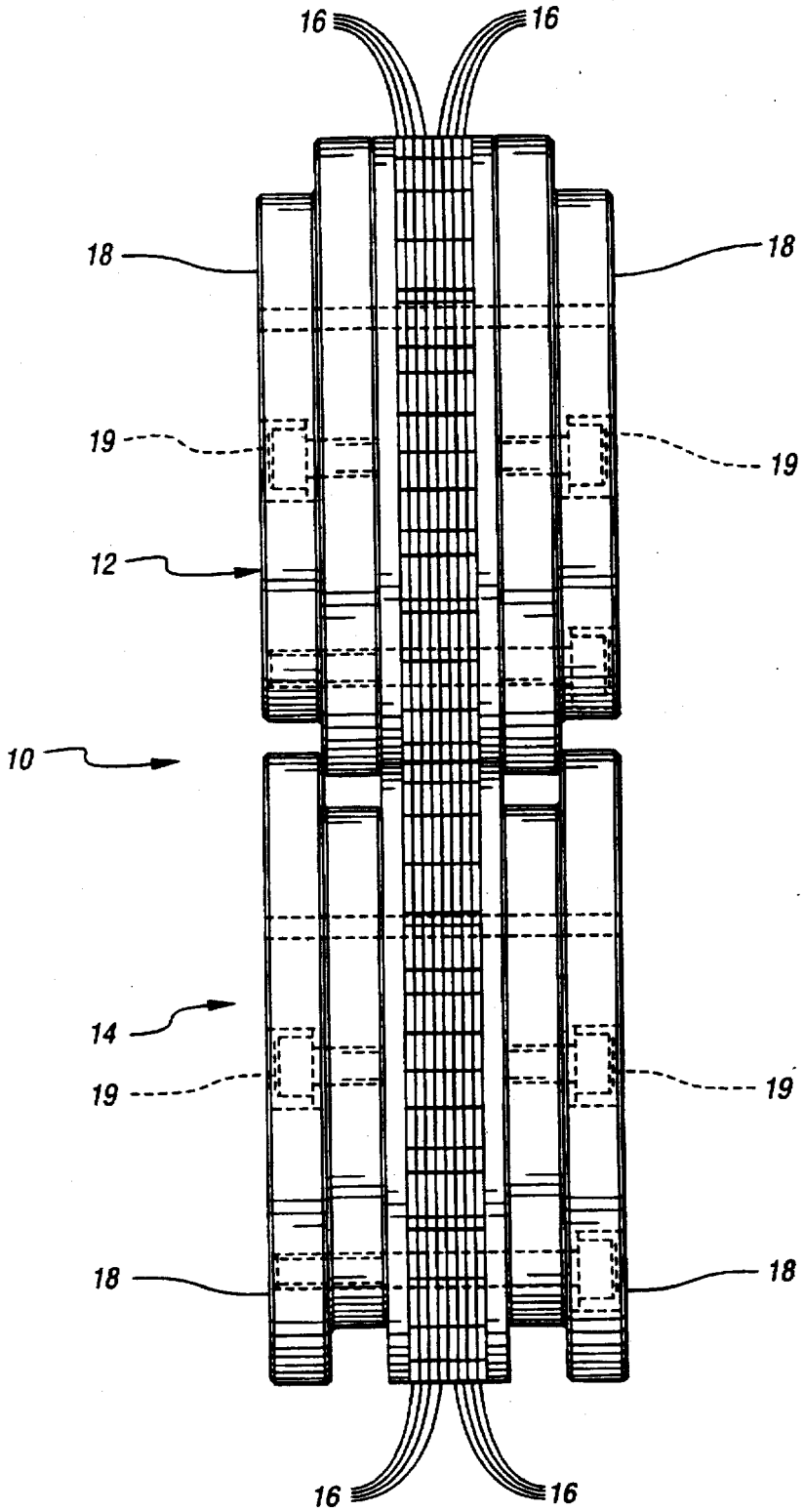
FIG. 2 is a side view of a roll forming tool used to manufacture the louvered serpentine fins in accordance with the present invention.

As shown in FIGS. 1 and 2, the tool 10 for forming these small turbulating structures into the louver surface is a roll forming tool. The roll forming tool 10 of the present invention includes two circular wheel assemblies 12, 14. Each of the wheel assemblies 12, 14 is generally circular and includes a plurality of star-shaped fin blades 16 stacked upon one another. The star-shaped fin blades 16 of wheel assembly 12 are located such that they intermesh with the star-shaped fin blades 16 of the wheel assembly 14. The fin blades 16 of each wheel assembly 12, 14 are sandwiched between a pair of end plates 18. The endplates 18 are secured to the blades 16 and the opposing end plate 18 by a fastener 19, such as a bolt or the like.

Each wheel assembly 12, 14 rotates around its center axis or center point (C) such that the fin blades 16 mate and cut, roll, and form serpentine louvers in a workpiece, such as a piece of metal, inserted between the wheel assemblies, as shown by the arrow A in FIG. 1.

Figure 3:
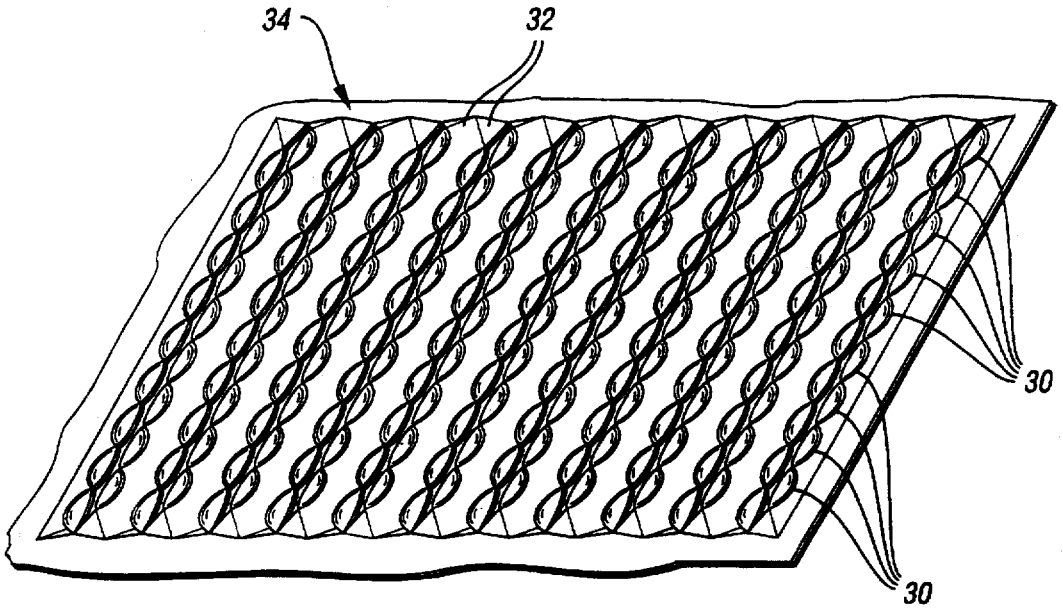
FIG. 3 depicts a louvered serpentine fin disposed in a heat exchanger manufactured by the disclosed tool in accordance with the present invention.
Figure 4A:
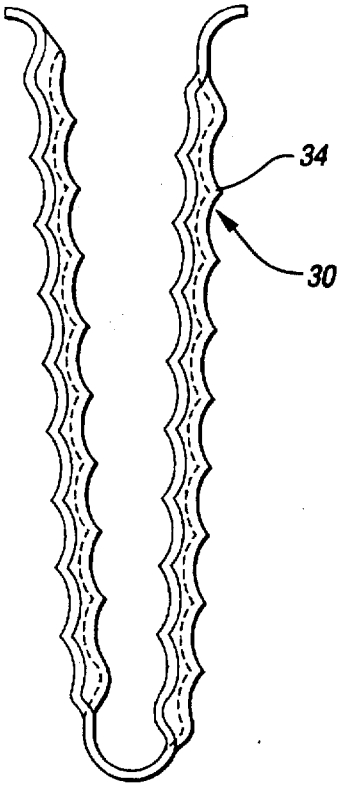
FIG. 4*a* is a sectional view of a louvered serpentine fin illustrating corrugated edges formed into the louvers thereof by the disclosed tool.
Figure 4B:
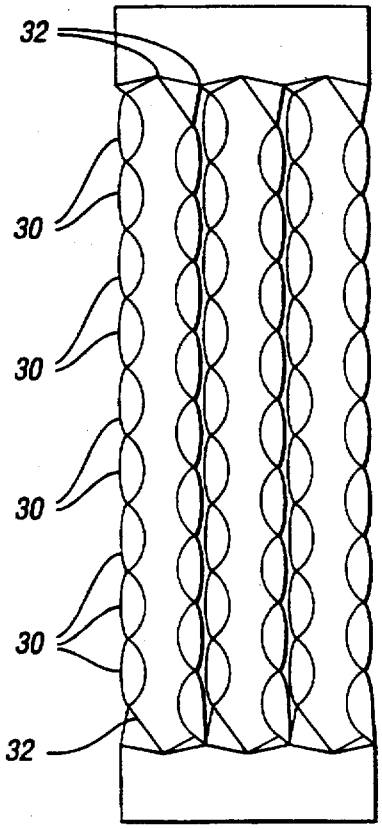
FIG. 4*b* is a top plan view of the configuration illustrated in FIG. 4*a;*
Figure 5:
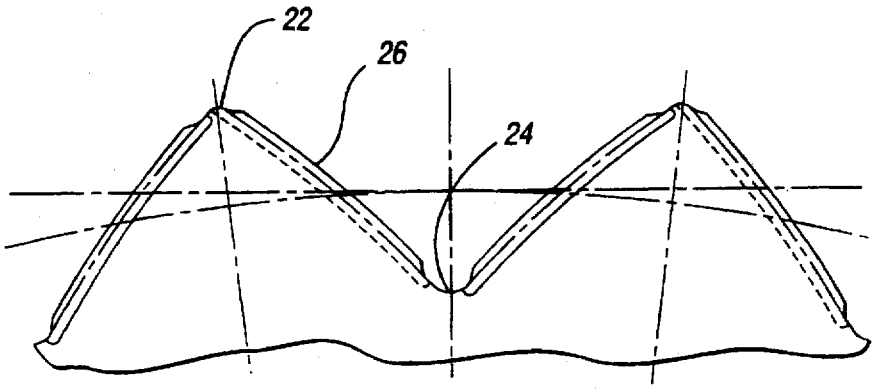
Fig. 5 (PRIOR ART)
FIG. 5 is a sectional view of a prior art roll forming tool blade that was used to manufacture a prior art fin.
Figure 6:
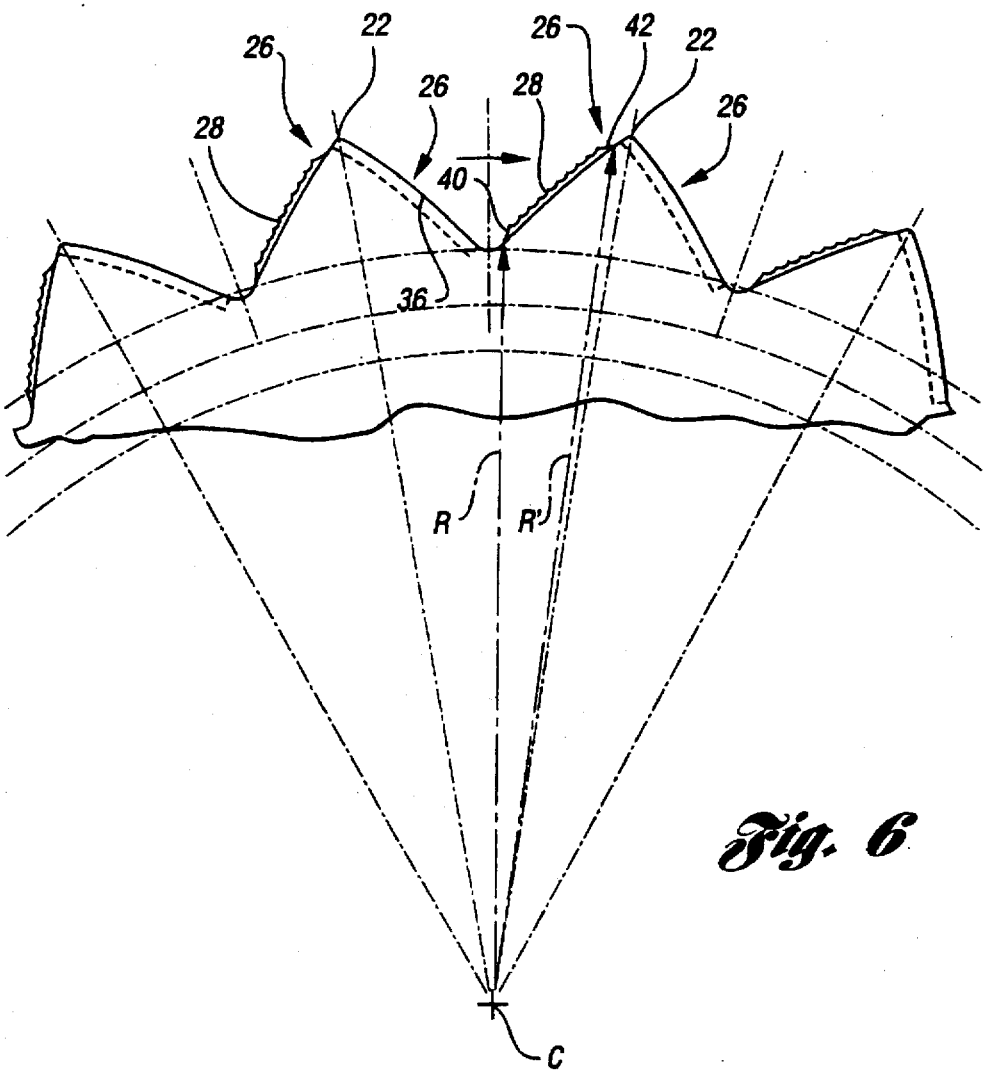
FIG. 6 is a side view of a portion of the roll forming tool blade used to manufacture the louvered fins in accordance with the present invention.

As shown in FIG. 6, the star-shaped fin blades 16 of the present invention each include a plurality of teeth 20. The teeth 20 each have a peak or tip 22 and a valley 24. In between each peak 22 and each valley 24 is a flat surface onto which a serrated cutting blade 26 is formed (FIG. 6). The serrated cutting blade 26 has a plurality of serrations 28 in the cutting blade 26 act to form a plurality of scallops 30 on the louvers 32 of each fin 34 (FIGS. 3 and 4). The serrations 28 on the cutting blade surface 26 are preferably concave with respect to the peripheral flank 36 of each cutting surface 26 of such fin blade 16. This does not imply that the serrations 28 cannot have a convex or pointed shape. As shown in FIG. 5, the prior art tools had a plurality of teeth with cutting blades 26 located between a tooth peak 22 and a tooth valley 24 that were smooth, i.e. they did not have any serrations.

Figure 7:
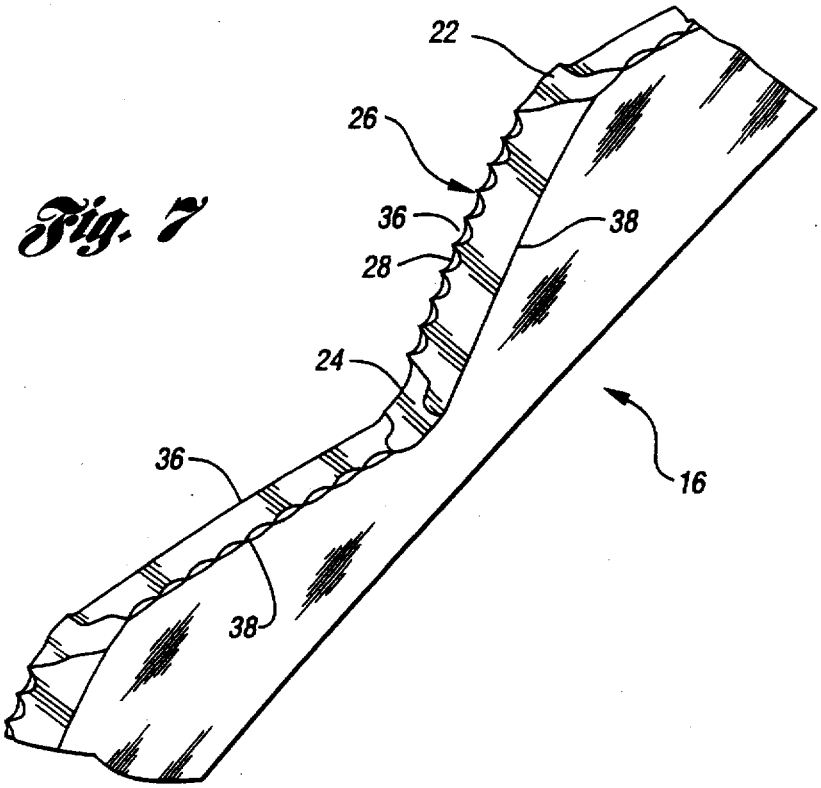
FIG. 7 is a perspective view broken away of a blade of a roll forming tool used to manufacture the louvered fins in accordance with the preferred embodiment of the present invention.

The serrated cutting blade 26 of the preferred tool is not constant. As shown in FIG. 7, it is wider near the valley 24 than it is at the peak 22. This is because the wear point of the blade 26 is localized at the peak 22 where any two adjacent serrations 28 intersect. At this localized point, the cutting blade 26 is approximately the size of a conventional cutting flat surface. Because the cutting edge flat surface 26 is at its narrowest here, this point where any two adjacent serrations 28 intersect will be more subject to wear than any other area. In the preferred tool, this peak area performs more of a piercing operation than a slitting one.

The finroll 10 of the present invention can make more finished fins 34 than the prior conventional finrolls before it is considered "worn out" for several reasons. The slitting action performed on the louver fin 34 by the cutting surface 25 and the cutting blade 26 is analogous to cutting with a pair of scissors. The peripheral flank 36 along the cutting edge 26 of the fin blade 16 is sharp and actually does the slitting and is subject to the most wear. Conventional finrolls have a cutting edge flat surface that is constant along almost the entire flank length of the blade. As this prior small flat surface wears, it creates an increasingly larger burr on the fin louver which is also constant along the entire length of the louver 32. As this burr gets larger due to cutting edge breakdown, it creates an obstruction which inhibits the passage of air through the fin 34, and thus inhibits heat transfer.

The narrowing of the cutting edge flat surface has two advantages with respect to tool life. First, it localizes any burr caused from cutting edge breakdown into an area on the fin 34 which may actually help to increase air turbulence. Second, it pierces a start in the workpiece for the louver slit instead of relying on the blunt edge shearing actions which start the louver slit on the conventional finroll. This decreases the required shearing forces that are transmitted to the bearings that support the finroll 10, thus reducing "bouncing" or vibration. It also reduces the amount of torque forces required to roll form the louvered fin 34.

Turning now to FIGS. 6 and 7, as discussed above, small serrations 28 have been formed or designed in the flat surface of the fin blades 16 to form a cutting blade 26. Serrations 28 preferably exist along the extreme flank edges of the cutting blade 26. In one embodiment, as shown in FIG. 7, the serrations 28 are formed on one periphery flank 36 of one cutting blade 26 and along the opposite flank 38 of the adjacent cutting blade 26. The shape of the serrations 28 or the positioning of the serrations 28 on the cutting blade 26 of the fin blades 16 is selected so as to achieve a turbulating contour in the louvers. Alternatively, in another embodiment, the scallops are formed on both peripheral edges 36, 38 of the louvers 32. The teeth 20 of the fin blades 16 are preferably pointed at their peaks 22 and also have an arcuate intersection at their valleys 24. However, the peaks 22 and the valleys 24 may also be curved or arcuate. The tooth form, however, should have no bearing on the existence of the serrations 28 or the resultant turbulating scallops 30. The tooth form aids in bending the fin 34 into its final serpentine shape. The serrations 28 need not be on every cutting edge in exactly the same shape or pattern. A mixture of turbulator shapes, frequency of existence, patterns, and locations are possible.

In the preferred embodiment, the finroll is manufactured with high grade tool steel, details of which are disclosed in copending application Ser. No. 08/554,542, entitled "Method and Apparatus For Making Heat Exchange Fins" hereby incorporated by reference. However, any fin blade material that is capable of supporting, cutting, rolling and forming the plain louvered fin is also acceptable.

FIG. 6 illustrates the cutting edges 36 of the preferred fin blade 28. On each cutting edge 36 is positioned a plurality of scallops 30. As discussed above, the size and positioning of the scallops 30 on the cutting edge 26 is not limiting. What is important is the inclusion of the scallops 30 themselves to create some turbulence—not their dimension. This is because the design of the scallops depends upon the length of the cutting edges and the angle and height of the louvers to be manufactured.

Figure 8A:
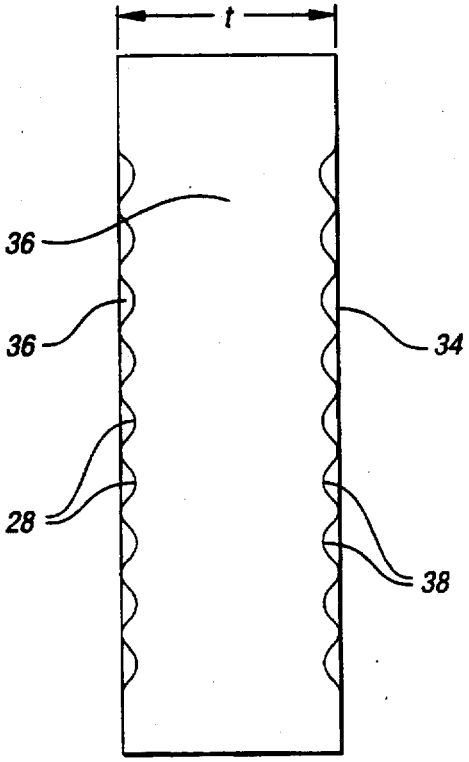
FIG. 8*a* is a partial sectional view of a blade of the roll forming tool in accordance with a preferred embodiment of the present invention.
Figure 8B:
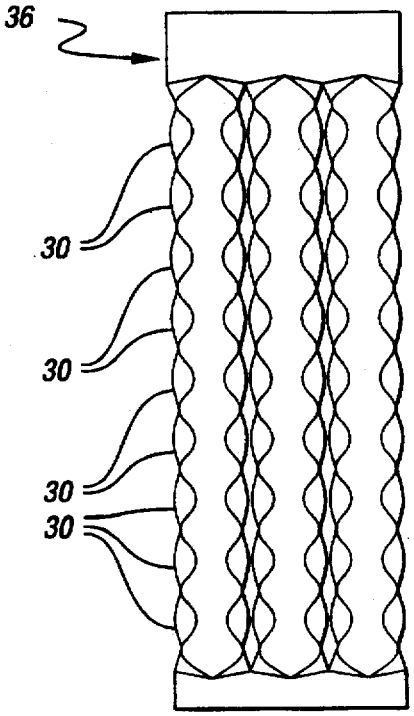
FIG. 8*b* is a top plan view of a corrugated edge formed in accordance with the preferred embodiment illustrated in FIG. 8*a*.

Turning now to FIGS. 8*a* and 8*b* which illustrate a serrated cutting edge 26 of thickness (t) and the resultant scalloped louver. In FIG. 8*a*, a portion of the fin blade is shown with serrations 28 formed on one flank 36 and a flat opposite peripheral flank 38 of the adjacent cutting edge 26. This will form scallops 30 on the louvers, as shown in FIG. 8*b*. As discussed above, the serration pattern can be changed to modify the resulting scallops 30 formed on the fin 34. For example, they can be in alignment as in FIG. 8*b*, or offset in any other pattern. Alternatively, the serrations 28 can be formed on both flanks 36, 38 of each cutting blade 26 to provide more scallops 30 on the louvered fin 34.

By way of example, in one test application, the blade edges 26 were designed to provide turbulating scallops 30 that would vary the cutting edge flat from 0.002 inches to 0.008 inches. In this test application, the scallops have a radius of 0.0280 inches. Additionally, in that test application the fin blades 16 were shaped such that the radius (R) from the center (C) of the blade 16 to the bottom serration 40 on each cutting surface 26 was about 2.3 inches. The radius (R') from the center (C) of the tool blade 16 to the top of the top serration 42 on each cutting surface 26 was about 2.5 inches. The wheel assemblies 12 and 14 included eight blades sandwiches between two end caps 18.

The first blade was an end blade having a diameter of about 5¼" that was approximately 0.160" thick. The next twelve blades are edge turbulating blades about 5¼" in diameter whose thickness is approximately 0.039". The next blade is a spacer approximately 4¼" in diameter and 0.042" thick. The next twelve blades are edge turbulating blades as described above but opposite. The last blade is another end blade same as the first end blade. Plate arrangement can vary.

Additionally, from peak 22 to valley 22, each serration 28 had a distance of 0.0055 inches. The distance from the center of one scallop 30 to the center of an adjacent serration 28 was 0.0334 inches. Based on the above dimensions, one of skill in the art can design a finroll for creating a scalloped louvered serpentine finroll for manufacturing a product which induces turbulence and promotes the efficiency of heat exchange.

Forming by the disclosed method using this tool automatically distorts true radial representation of arcs into cycloidal or parabolic shapes. This distortion increases the farther the form is from the running pitch diameter, which exists halfway between the tool centers. Distortion can be compensated for if the need arises.

The tool of the present invention cuts, rolls, and forms a plurality of turbulators or scallops which create minute eddies and currents which scrub the heat exchanger surface and thermal energy is more efficiently transferred to the turbulated media. The resultant turbulated fin 34 has a plurality of turbulators or scallops 30 formed thereon that create these minute eddies and currents and still maintains the louver's deflection properties in order to direct the exit of the heat/cool saturated media. An example of a turbulator shape has been sketched to show versatility. The shape and/or frequency of the turbulators can be engineered according to user preference and disked fin dimension. See, e.g., FIGS. 3, 4*a* and 4*b*.

While only one preferred embodiment of the invention has been described hereinabove, those of ordinary skill in the art will recognize that this embodiment may be modified and altered without departing from the central spirit and scope of the invention. Thus, the embodiment described hereinafter is to be considered in all respects as illustrative and not restrictive, the scope of the invention being indicated by the appended claims, rather than by the foregoing descriptions, and all changes, which come within the meaning and range and equivalency of the claims are intended to be embraced herein.

What is claimed is:

1. A tool for manufacturing scalloped, louvered serpentine fins comprising:

two rotatable wheel assemblies;

a plurality of fin blades included in each of said wheel assemblies;

each of said fin blades including one or more teeth, each tooth having a peak and a valley;

one or more cutting surfaces, each cutting surface lying between a peak and a valley; and a plurality of serrations formed on at least one of said one or more cutting surfaces for creating the scalloped, louvered serpentine fin from a workpiece that is passed between said two wheel assemblies.

2. The tool of claim 1, wherein each fin blade has a first edge and a second edge, said serrations on a given fin blade being located on opposite edges of adjacent cutting surfaces separated by a given valley.

3. The tool of claim 1, wherein each fin blade has a first edge and a second edge, said serrations on a given fin blade being located on the same edge.

4. The tool of claim 1, wherein said serrations on a given fin blade are located on a first and a second cutting surface separated by a given valley such that the distance from the center of said fin blade to the center of each of said serrations on said first cutting surface is equal to the distance from said center of said fin blade to said center of each of said serrations on said second cutting surface.

5. The tool of claim 1, wherein said serrations on a given fin blade are located on a first and second cutting surfaces separated by a given valley such that the distance from the center of said fin blade to the center of each serration on said first cutting surface is offset from the distance from said center of said fin blade to said center of each of said serrations on said second cutting surface.

6. The tool of claim 1, wherein each of said serrations on a given fin blade has generally rounded peaks.

7. The tool of claim 1, wherein each of said serrations on a given fin blade has generally pointed peaks.

8. The tool of claim 1, wherein each of said cutting surfaces is narrower near said peak than at said valley.

9. The tool of claim 1, further including a pair of end caps for sandwiching said plurality of fin blades therebetween.

10. A fin blade for a finroll used to manufacture scalloped louvered serpentine fins, comprising:

a plurality of teeth uniformly spaced about the periphery of said fin blade;

each of said teeth having a peak and a valley;

a plurality of cutting surfaces each located between a respective one of said peaks and a respective one of said valleys; and a plurality of serrations formed in said cutting surfaces.

11. The fin blade of claim 10, wherein each fin blade has a first edge and a second edge, said serrations on a given fin blade being located on opposite edges of adjacent cutting surfaces separated by a given valley.

12. The fin blade of claim 10, wherein each fin blade has a first edge and a second edge, said serrations on a given fin blade being located on the same edge.

13. The fin blade of claim 10, wherein said serrations on a given fin blade are located on a first and second cutting surface separated by a given valley such that the distance from the center of said fin blade to the center of each of said serrations on said first cutting surface is equal to the distance from said center of said fin blade to the center of each of said serrations on said second cutting surface.

14. The fin blade of claim 10, wherein said serrations on a given fin blade are located on a first and second surface separated by a given valley such that the distance from the center of said fin blade to the center of each serration on said cutting surface is offset from the distance from said center of said fin blade to said center of each of said serrations on said second cutting surface.

15. The fin blade of claim 10, wherein each of said serrations on a given fin blade has generally rounded peaks.

16. The fin blade of claim 10, wherein each of said serrations on a given fin blade has generally pointed peaks.

* * * * *